US006589065B2

(12) United States Patent
Trout et al.

(10) Patent No.: US 6,589,065 B2
(45) Date of Patent: Jul. 8, 2003

(54) LEVER ACTUATED ZIF PROCESSOR SOCKET

(75) Inventors: David Allison Trout, Wrightsville, PA (US); Michael Anthony Yeomans, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/222,725

(22) Filed: Aug. 16, 2002

(65) Prior Publication Data

US 2002/0197901 A1 Dec. 26, 2002

Related U.S. Application Data

(62) Division of application No. 09/977,848, filed on Oct. 15, 2001, now Pat. No. 6,482,022, which is a continuation of application No. 09/672,561, filed on Sep. 28, 2000, now Pat. No. 6,338,639.

(60) Provisional application No. 60/202,987, filed on May 9, 2000.

(51) Int. Cl.[7] ..... H01R 13/625

(52) U.S. Cl. ..... 439/342

(58) Field of Search ..... 439/342, 259, 439/262, 263, 266, 268

(56) References Cited

U.S. PATENT DOCUMENTS

| | | | | |
|---|---|---|---|---|
| 6,280,223 | B1 | 8/2001 | Lin | 439/342 |
| 6,368,139 | B1 * | 4/2002 | Ohkita et al. | 439/342 |
| 6,406,317 | B1 * | 6/2002 | Li et al. | 439/342 |

* cited by examiner

*Primary Examiner*—Renee Luebke
*Assistant Examiner*—Felix O. Figueroa

(57) ABSTRACT

A zero insertion force socket includes a cover which is movable along a longitudinal axis relative to a base housing. An actuation member is mounted for rotation about a rotation axis that is parallel to the longitudinal axis. The actuation member is operably connected for moving the cover along the longitudinal axis when the actuation member is rotated about the rotation axis. The actuation member may include a leg that extends along the rotation axis, and a handle that extends perpendicular to the leg. The leg includes at least one thread that is received in a recess in the cover.

6 Claims, 13 Drawing Sheets

LEVER ACTUATED ZIF PROCESSOR SOCKET

CROSS REFERENCE TO RELATED APPLICATIONS

This application is a division of U.S. application Ser. No. 09/977,848 filed Oct. 15, 2001, now U.S. Pat. No. 6,482,022, which is a continuation of U.S. application Ser. No. 09/672,561 filed Sep. 28, 2000, now U.S. Pat. No. 6,338,639, which claims priority from Provisional Application No. 60/202,987 filed May 9, 2000, and these prior applications are incorporated herein by reference.

BACKGROUND OF THE INVENTION

The preferred embodiments of the present invention generally relate to electrical sockets, such as pin grid array (PGA) sockets. More specifically, the preferred embodiments of the present invention generally relate to zero insertion force (ZIF) processor sockets.

Heretofore, PGA sockets have been proposed that include a base having a cover slidably mounted thereon. The sliding motion between the base and cover is controlled in numerous manners in conventional ZIF PGA sockets. For example, U.S. Pat. No. 5,256,080 discloses a bail actuated ZIF socket. U.S. Pat. No. 5,730,615 describes a ZIF PGA socket that uses a flat or plate tool that is inserted into receiving slots in the cover and base. The flat tool is moved between two positions in order to open and close the ZIF socket. U.S. Pat. No. 4,498,725 discloses a prior art PGA socket having a base housing and a moveable cover. An L-shaped lever moves the cover across a top surface of the housing. The lever includes a first arm that is rotatably received in a passage in the socket and a second arm that provides a handle for rotating the first arm.

However, existing ZIF sockets have experienced limited applicability to certain processor designs. For instance, many circuit designs are conditioned on PGA chips being arranged in a closely packed manner with respect to one another. For instance, at least one conventional socket uses an actuation lever located along one side of the socket and is moved in the same direction as the direction of relative movement between the cover and base housing. For instance, the lever is moved forward along the side of the socket to drive the cover forward and visa versa. However, as components decrease in size and are located closer to one another, space constraints no longer permitted the lever to be located along the side of the socket. Thus, it is desirable to minimize the width of sockets holding the PGA chips.

Also, as chip technology evolves, the number of pins on a single chip increases. The socket achieves a separate electrical contact with each pin on a chip and thus the number of electrical contacts to be maintained by a socket is increased. As the pin/contact count increases, the force required to electrically engage the chip and socket similarly increases. Conventional sockets focus significant actuation forces on small areas on the cover and housing. As the actuation forces increase, various socket designs experience more faults as the housing and cover are unable to withstand the increased loads. Conventional sockets for high pin count PGA chips do not spread actuation forces over the entire housing/cover.

A need remains for an improved socket. It is an object of the preferred embodiments of the present invention to meet this and other needs that will become apparent from the following description, drawings and claims.

BRIEF SUMMARY OF THE INVENTION

In accordance with at least one preferred embodiment, a socket is provided for an electronic package. The socket includes a cover and base housing that are slidably engaged with one another. The cover and base housing are moveable between open and closed positions along a socket longitudinal axis. The socket further includes an actuation member configured to move the cover when the actuation member is rotated about a rotational axis. The actuation member is aligned such that the rotational axis of the actuation member is parallel to the socket longitudinal axis along which the cover and base housing move relative to one another. The actuation member drives the cover along the longitudinal axis between open and closed positions when the actuation member is rotated about the rotational axis.

In accordance with at least one alternative embodiment, the actuation member comprises a cam assembly slidably received within a journaled portion of the base housing. The cam assembly transfers rotary motion of the actuation member about the rotational axis to linear motion along the longitudinal axis. In accordance with at least one alternative embodiment, the cam assembly has at least one pusher bar mounted thereon. The pusher bar slidably engages the cover to drive the cover between open and closed positions. The cam assembly may include a plurality of pusher bars and the cover may include an equal plurality of slots slidably receiving the pusher bars. The pusher bars and slots are aligned at an angle to the socket longitudinal axis such that movement of the actuation member along a transverse axis in a direction at an angle to the socket longitudinal axis drives the cover along the longitudinal axis. The chamber in the base housing or cover may be located near the rear end thereof. The chamber includes tracks along opposite sides that receive a cam assembly included within the actuation member. The cam assembly is movable within the tracks laterally from one side to the other side of the base housing or cover.

In accordance with at least one alternative embodiment, the actuation member includes a lever having a handle and a leg. The leg includes an offset cam journal movable along an arcuate path when the handle is rotated about the rotational axis. The cam journal causes the cover to open and close when the handle is rotated. The actuation member may include a main journaled portion extending along a common axis that defines the rotational axis and that is separated by an offset cam journal. The chamber in one of the base housing and cover may include cutouts that receive the main journaled portions. The cutouts may be positioned to align the rotational axis parallel to the longitudinal axis.

In accordance with at least one alternative embodiment, the actuation member includes a rotating lever and a sliding cam. The rotating lever is rotatable about a rotational axis to drive the sliding cam in a direction perpendicular to the longitudinal axis. The sliding cam drives the cover along the longitudinal axis. The actuation member engages the cover at multiple points evenly distributed along a width of the cover between the sides of the cover thereby spreading actuation force over a wide surface area of the cover.

In accordance with yet a further alternative embodiment, the actuation member includes a handle and a leg rotatable about the rotational axis. The leg includes threads engaging corresponding threads in at least one of the cover and base housing. The leg drives the cover between open and closed positions as the handle is rotated. The actuation member may include one or more threaded shafts located near the rear end of the base housing and evenly distributed between sides of the base housing. The threaded shaft causes the cover to move when the shaft is rotated.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are present preferred. It should be understood, however, that the present invention is not limited to the precise arrangements and instrumentality shown in the attached drawings.

DETAILED DESCRIPTION OF THE INVENTION

Figure 2:
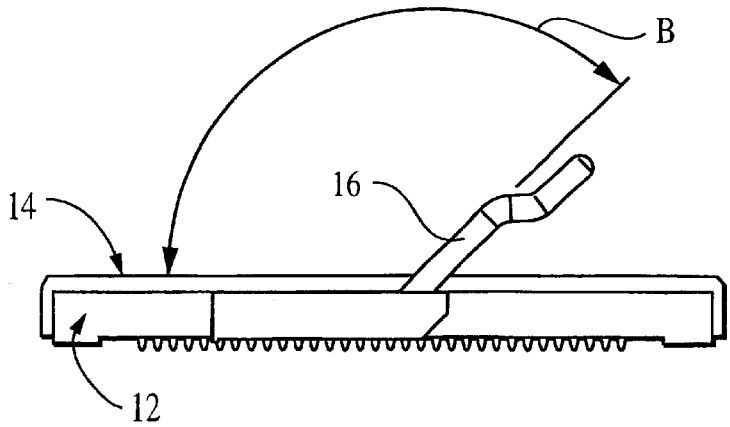
FIG. 2 illustrates an end view of a socket in accordance with a preferred embodiment of the present invention while in an open position.
Figure 3:
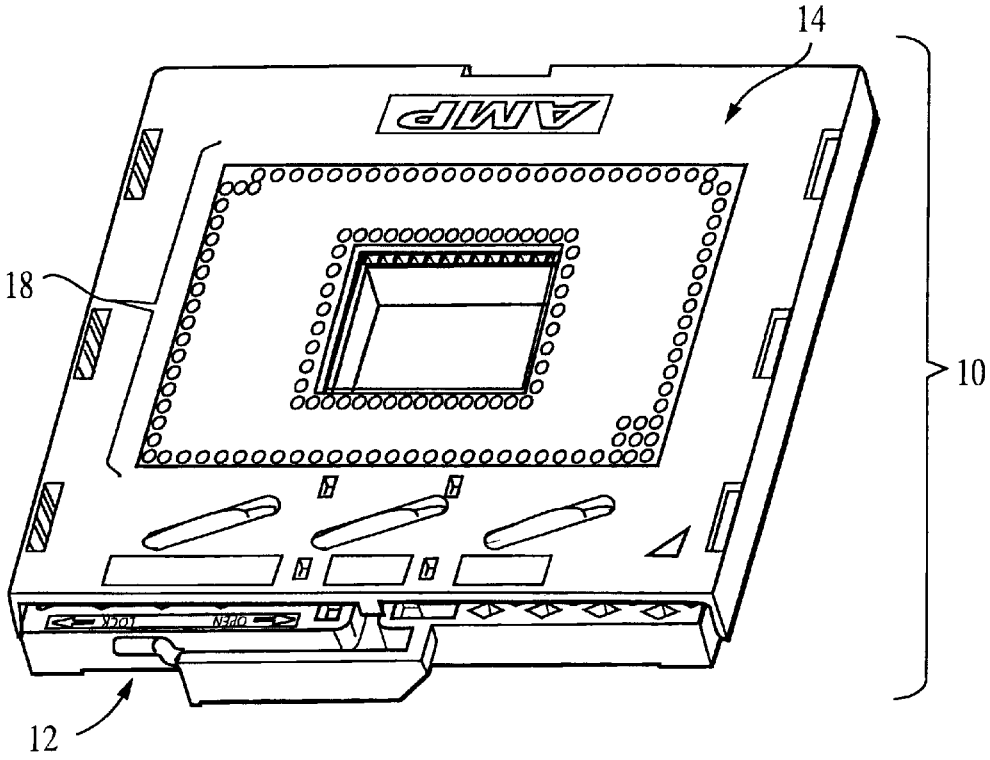
FIG. 3 illustrates a perspective view of a socket in accordance with a preferred embodiment of the present invention while in a closed position.
Figure 4:
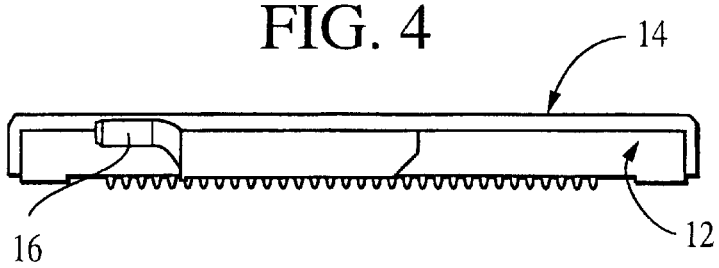
FIG. 4 illustrates an end view of a socket in accordance with a preferred embodiment of the present invention while in a closed position.
Figure 6:
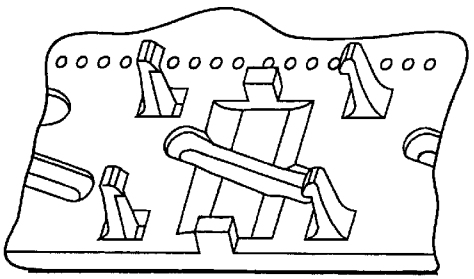
FIG. 6 illustrates a detailed view of a portion of the underside of the cover of a socket in accordance with a preferred embodiment of the present invention.

FIGS. 1–2 and 3–4 illustrate a socket 10 in accordance with a preferred embodiment of the present invention when in opened and closed positions, respectively. The socket 10 includes a front 11, back end 13, and sides 15 and 17. The socket 10 generally includes a base housing 12 and a cover 14 slidably engaging one another. The base housing 12 and cover 14 are moved between open and closed positions (FIGS. 1 and 3, respectively) by moving a lever 16 between an open position (FIG. 2) and a closed position (FIG. 4). The cover 14 includes a processor pin pattern 18. The base housing 12 includes a pin pattern 20 (FIG. 7) associated with the pin pattern 18.

Figure 5:
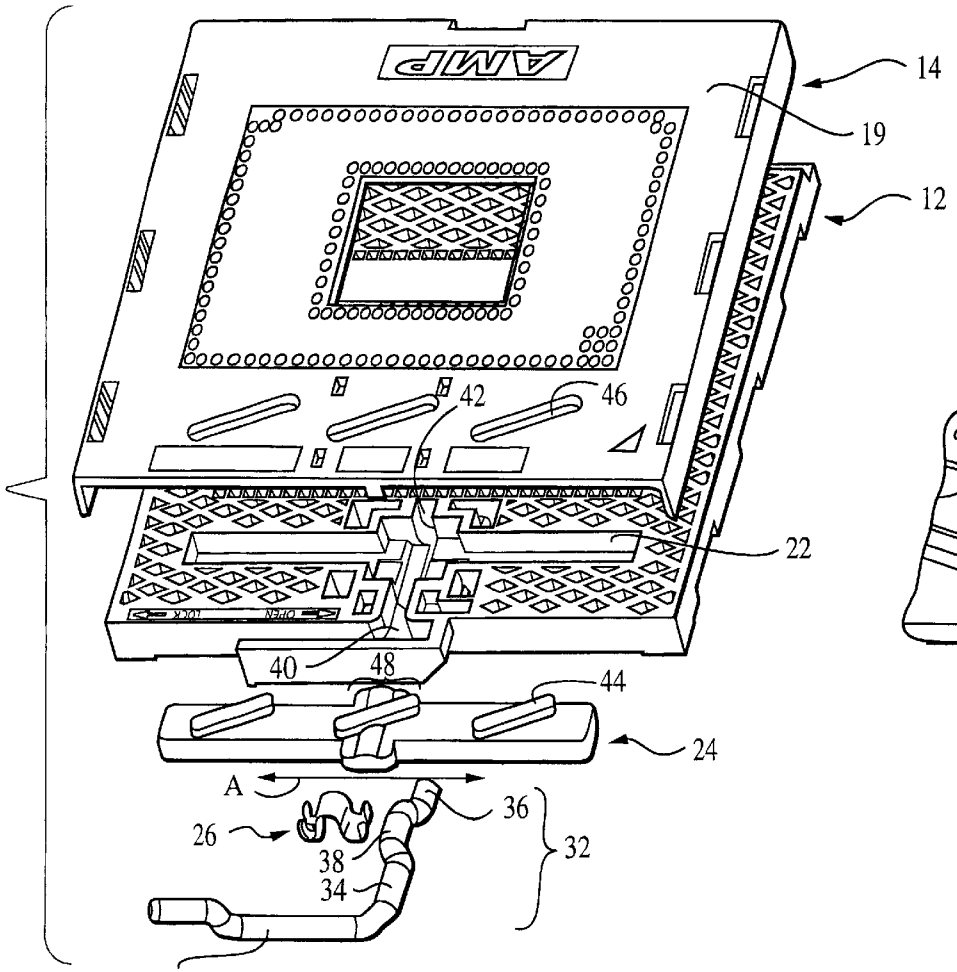
FIG. 5 illustrates an exploded perspective view of a socket in accordance with a preferred embodiment of the present invention.

FIG. 5 illustrates an exploded view of the socket 10. The base housing 12 includes a rectangular journaled portion 22 that receives a rectangular cam assembly 24. The cam assembly 24 is slidably movable within the journaled portion 22 in a lateral direction (from side to side) denoted by arrow A. A metal wear plate 26 is securely mounted to an under surface of the cam assembly 24. The wear plate 26 rotatably communicates with an actuation lever 28. The journaled portion 22 includes tracks 23 (FIG. 7) along opposite sides thereof to permit lateral movement of the cam assembly 24. The actuation lever 28 includes a handle 30 and a leg 32. The leg 32 includes main journal portions 34 and 36 extending along a common longitudinal axis and separated by an offset cam journal 38. The main journaled portions 34 and 36 are received within cut-outs 40 and 42 in the base housing 12 located on either side of the journaled portion 22. The cam journal 38 rotatably contacts the metal wear plate 26.

Once assembled, when the handle 30 is moved along the arcuate path designated by arrow B in FIG. 2, the leg 32 rotates about its longitudinal axis, thereby causing the cam journal 38 to similarly pivot along an arcuate path. As the cam journal 38 pivots along an arcuate path, the interaction between the cam journal 38 and wear plate 26 drive the cam assembly 24 laterally along the direction designated by arrow A.

Figure 1:
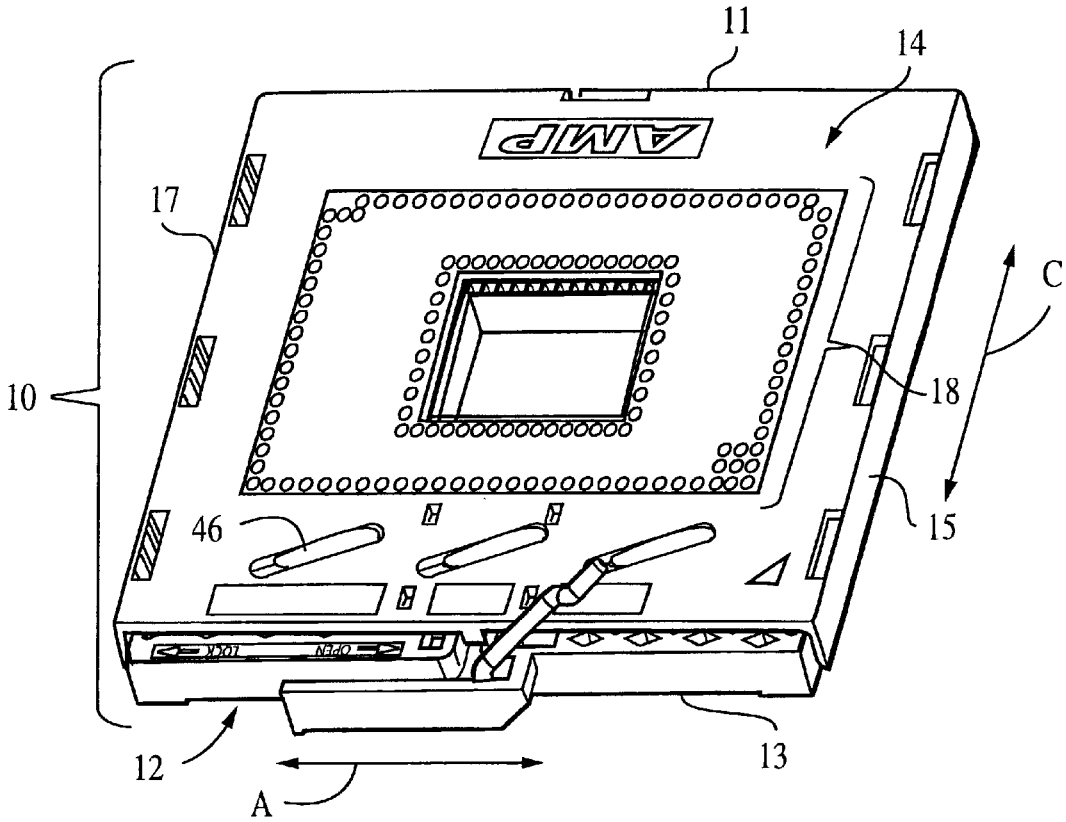
FIG. 1 illustrates a perspective view of a socket in accordance with a preferred embodiment of the present invention while in an open position.

The cam assembly 24 includes a plurality of pusher bars 44 mounted on the upper surface 43 thereof. The pusher bars 44 are slidably received within slots 46 in the top 19 of the cover 14. The pusher bars 44 are arranged such that the longitudinal axes of the pusher bars 44 extend parallel to one another and form an acute angle with respect to the longitudinal axis of the cam assembly 24. By way of example only, the pusher bars 44 may extend at approximately a 25° angle with respect to the longitudinal axis of the cam assembly 24. As the cam assembly 24 moves in the direction of arrow A, the pusher bars 44 slidably engage the sidewalls of the slots 46, thereby causing the cover 14 to slide relative to the base housing 12 between the open and closed positions. By way of example, the cam journal 38 may be driven along an arcuate path E (FIG. 12) aligned in a vertical plane extending perpendicular to the longitudinal axis of the cam assembly 24. The cam journal 38 drives the pusher bars 44 laterally with respect to the socket 10 causing the pusher bars 44 to move from one end to an opposite end of the slots 46 (as shown in FIGS. 1 and 3). As the pusher bars 44 move within slots 46, the pusher bars 44 force the cover 14 to move in a direction C that is perpendicular to the lateral movement of the pusher bars 44. The cover 14 moves between the front and back ends 11 and 13 of the socket 10.

Optionally, the pusher bars 44 may be aligned at an angle to the longitudinal axis of the cam assembly 24 that is greater than or less than approximately 25°. The angular relation between the pusher bars 44 and the longitudinal axis of the cam assembly 24 may be adjusted based upon the amount of movement that is required between the cover 14 and the base housing 12. Optionally, the number of pusher bars 44 may be increased or decreased, and the size of each pusher bar varied in order to further divide the actuating force along the width of the socket 10. The cam assembly 24 and actuation lever 28 cooperate to spread the actuation force over a wide surface area of the socket 10. In particular, the actuation force is divided along the adjoining surfaces of the slots 46 and pusher bars 44. Thus, by varying the number and size of pusher bars 44 and slots 46, the distribution of the actuation force may be similarly varied across the width of the cover 14. The cam assembly 24 includes a central block section 48 to provide additional support and strength in the region at which the wear plate 26 and actuation lever 28 operate.

Figure 7:
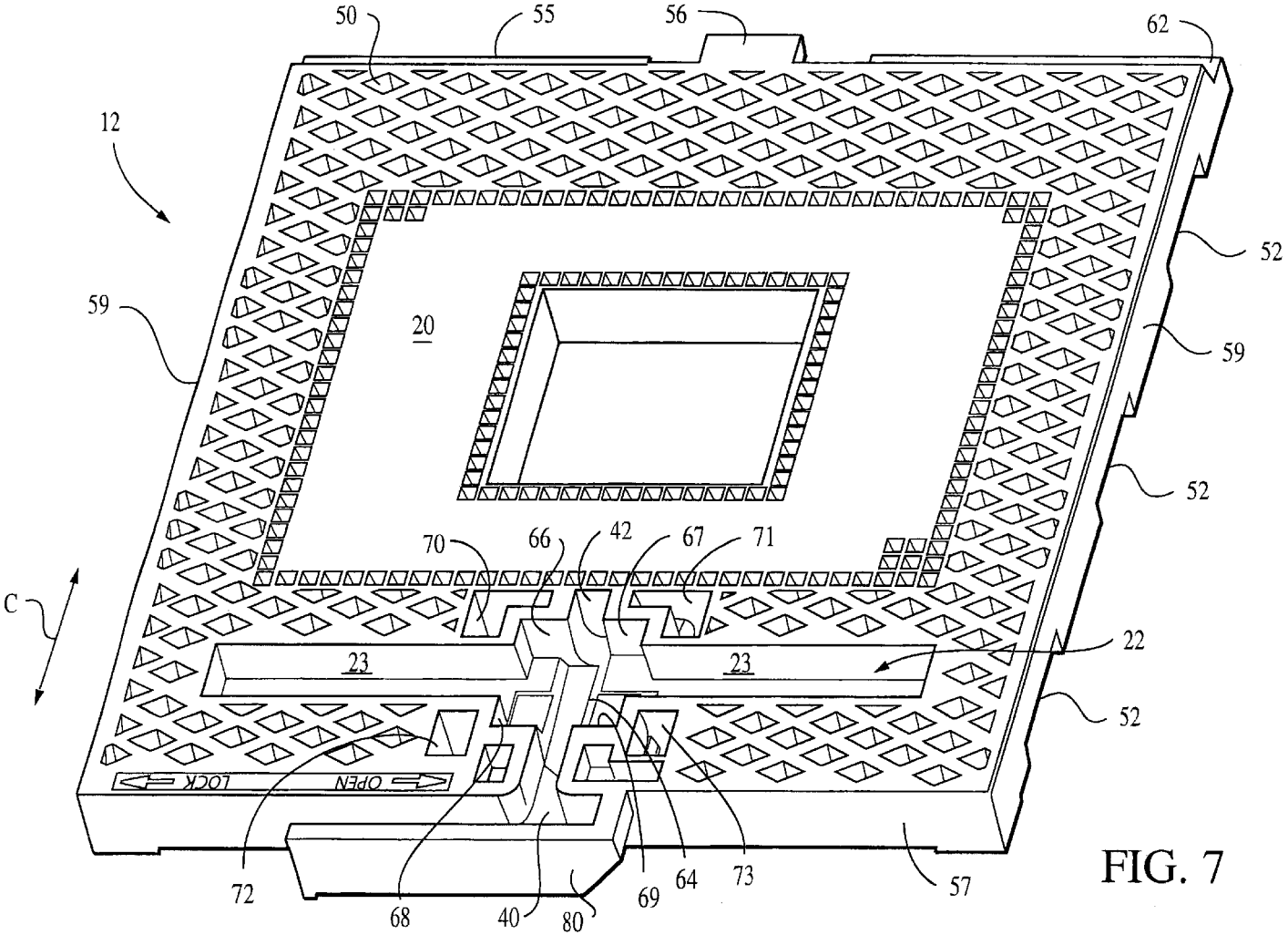
FIG. 7 illustrates a perspective view of the base housing of a socket in accordance with a preferred embodiment of the present invention.

FIG. 7 illustrates a perspective view of the base housing 12 in more detail. The base housing 12 includes a front surface 55, a back surface 57 and sides 59. The cover 14 includes a front end wall 60, side walls 84, a bottom surface 82 and back edge 83. The base housing 12 includes a pin pattern 20 associated with the pin pattern 18. Optionally, the base housing 12 may include a plurality of core voids to prevent warping or distortion during manufacturing. The base housing 12 includes a plurality of latching surfaces 52 that slidably engage outer latches 54 on the cover 14 (FIG. 8) to retain the cover 14 in close proximity to the base housing 12. The latches 54 and latching surfaces 52 cooperate to hold the cover 14 down upon the base housing 12. A tab 56 on the base housing 12 is received within an opening 58 in the end wall 60 of the cover 14 to retain the base housing 12 and cover 14 in a desired relation to one another. A ledge 62 is formed along the front surface 55 of the base housing 12 to receive the end wall 60 when the socket 10 is closed. The journaled portion 22 includes an arcuate trough 64 centrally located therein traversing the journaled portion 22 to rotatably receive the leg 32 of the actuation lever 28. Recessed notch portions 66–69 receive, and permit lateral movement of, the block section 48 of the cam assembly 24. Pockets 70–73 snapably receive latches 74–77, respectively, to securely retain the cover 14 against the base housing 12, while permitting forward and reverse sliding movement between the base housing 12 and cover 14 in the direction designated by arrow C. A protective cover 80 is provided to receive the handle 30 of the actuation lever 28 while in a closed or locked position. The protective cover 80 includes a latch 400 (FIG. 16) to retain the handle 30 in a locked position and includes a stop 410 to limit the travel of the handle 30 in the open position.

Figure 8:
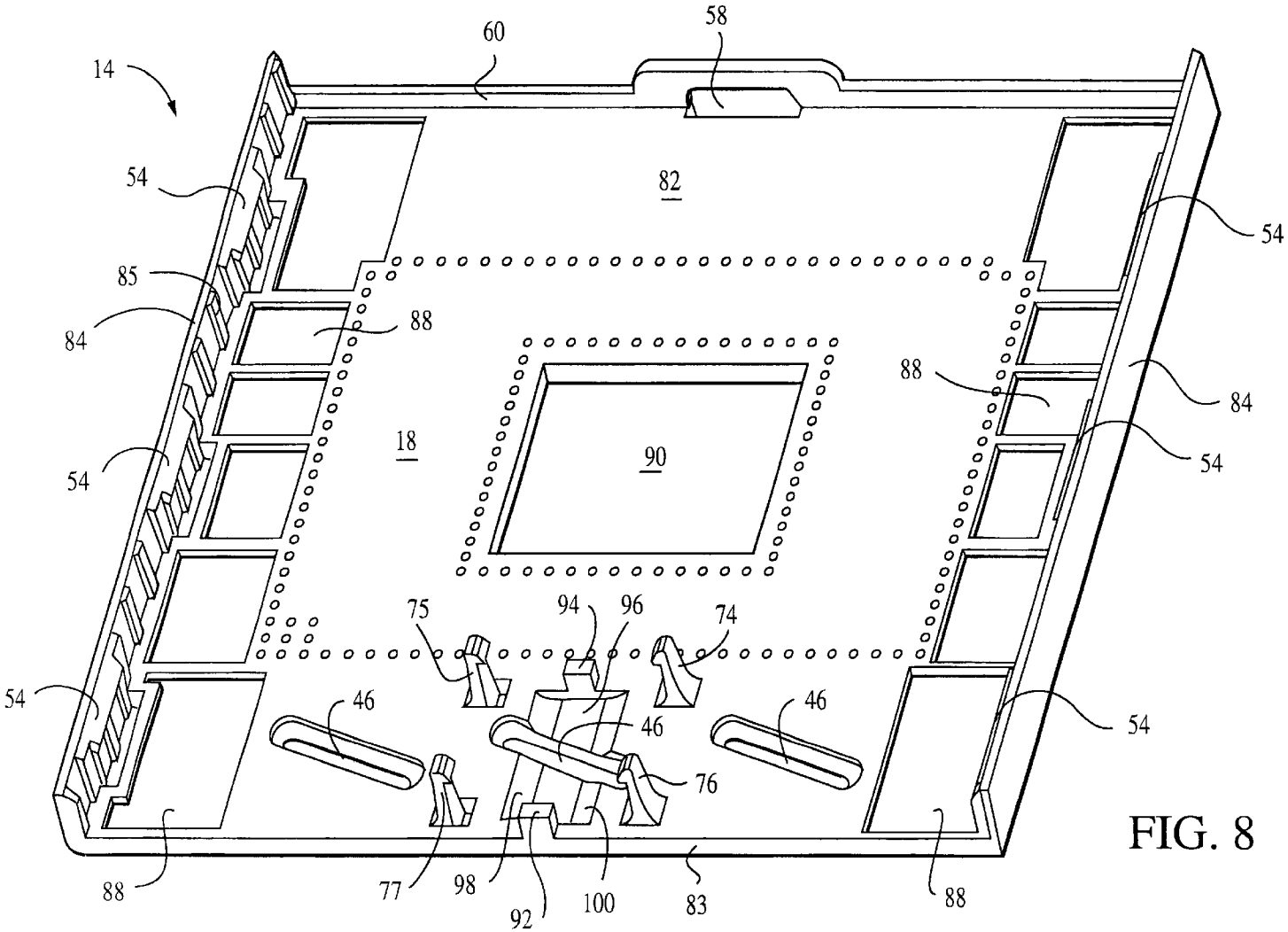
FIG. 8 illustrates a perspective view of the underside of the cover of a socket in accordance with a preferred embodiment of the present invention.

Turning to FIG. 8, the interior of the cover 14 is illustrated in more detail. The cover 14 includes a bottom surface 82 including the pin pattern 18 therein. The cover 14 includes side walls 84 and an end wall 60 located near the front 11 of the socket 10. The side walls 84 include a plurality of vertical skirts 86 thereon to provide structural rigidity. The outer latches 54 are distributed along the interior of both side walls 84. Recesses 88 may be provided as core voids to facilitate and balance the flow of plastic compound during manufacturing. Optionally, an opening 90 may be provided in the center of the cover 14. Center posts 92 and 94 project outward from the bottom surface 82 of the cover 14. The center posts 92 and 94 have upper surfaces that are located proximate the main journals 34 and 36 of the leg 32 on the actuation lever 28. The center posts 92 and 94 cooperate with the cut-outs 40 and 42 to define bearings, within which the main journals 34 and 36 rotate, while limiting movement of the leg 32 in any other direction.

Figure 9:
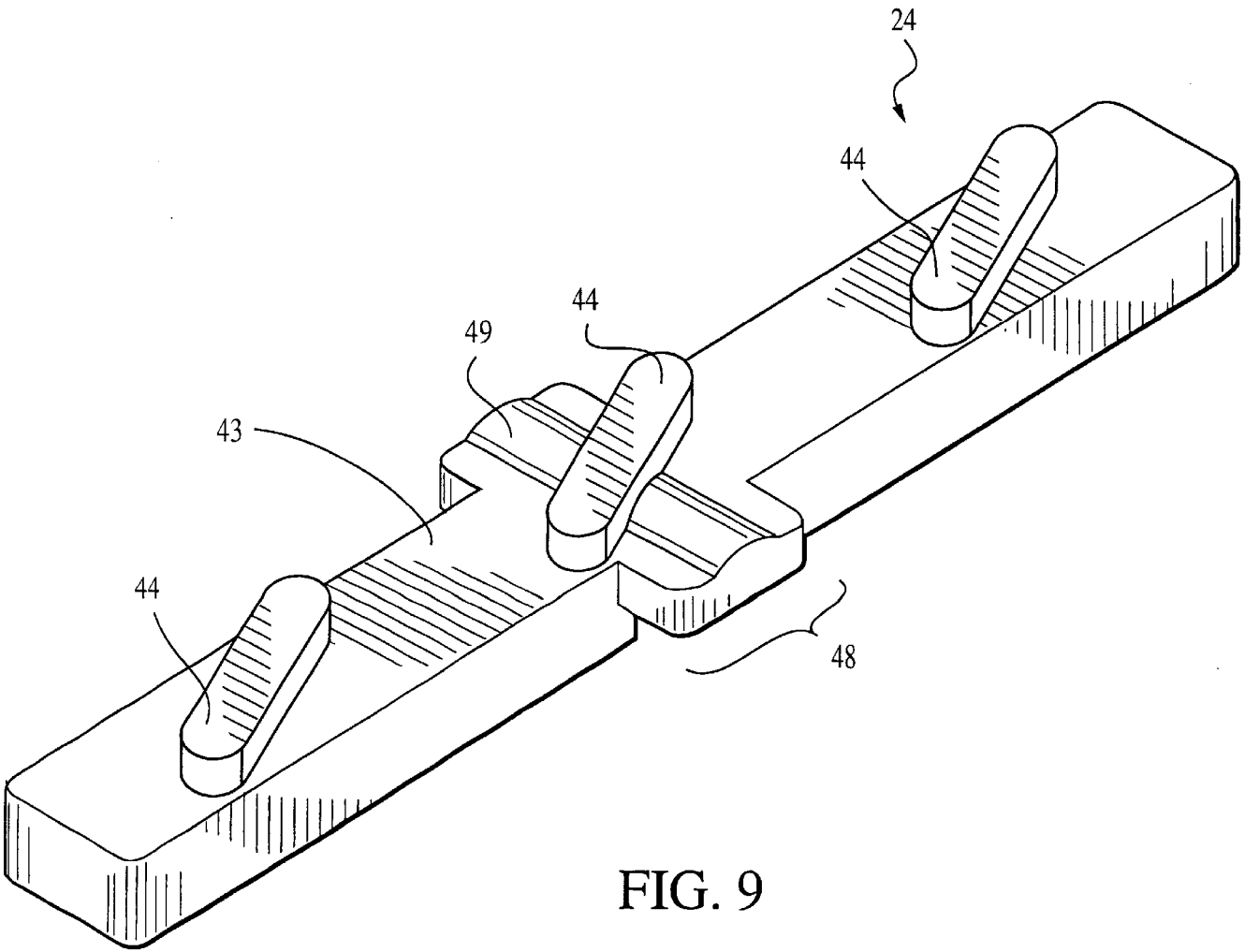
FIG. 9 illustrates a cam assembly slidably received within the base housing of a socket in accordance with a preferred embodiment of the present invention.

The bottom surface 82 includes a recessed portion 96 near the back edge 83 and chamfered regions 98 and 100 to receive the upper portion of the block section 48 on the cam assembly 24. The recessed portion 96 may be arcuately shaped to follow the contour of the dome shaped top 49 (FIG. 9) of the block section 48.

Figure 10:
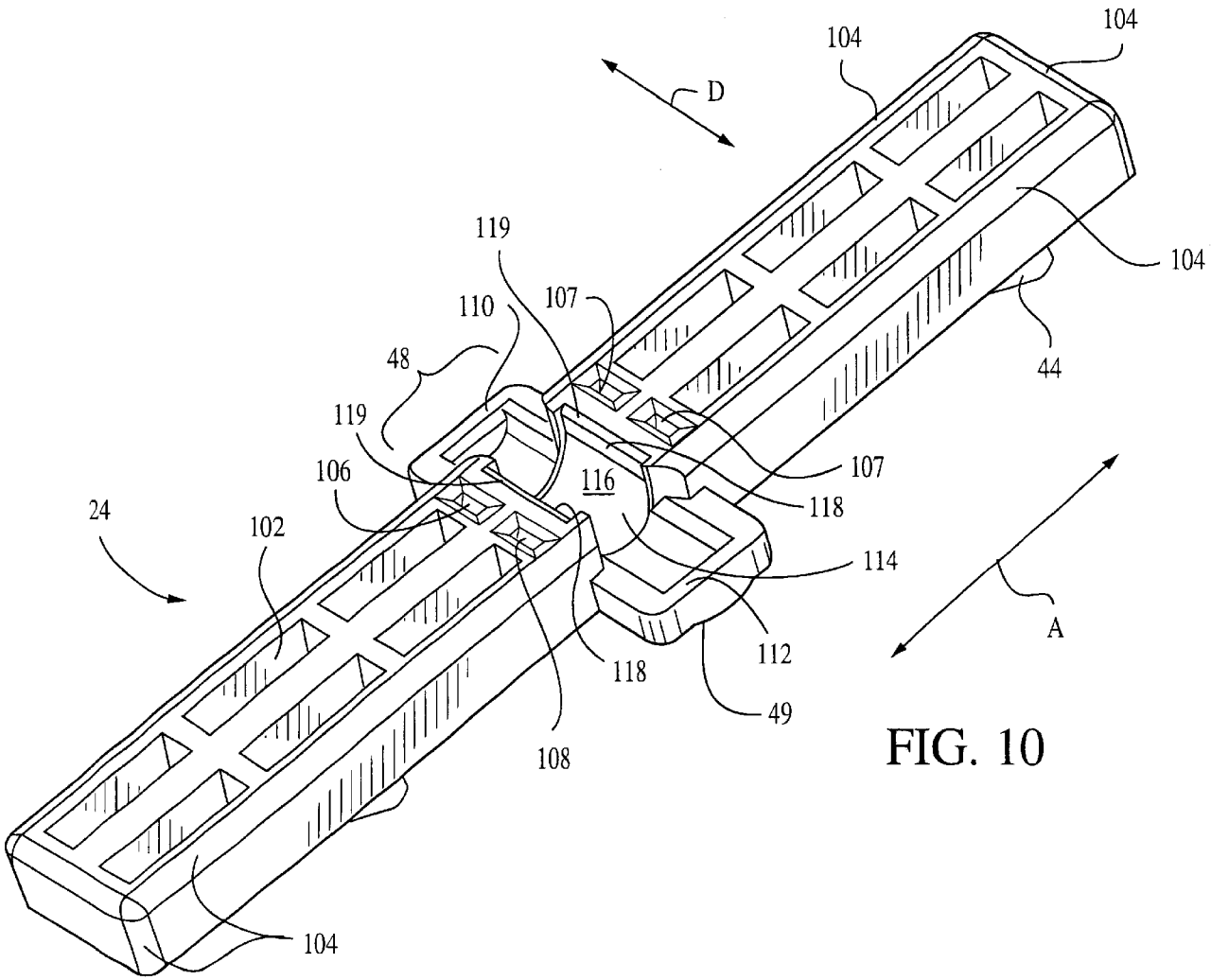
FIG. 10 illustrates the underside of a cam assembly utilized in accordance with a preferred embodiment of the present invention.
Figure 11:
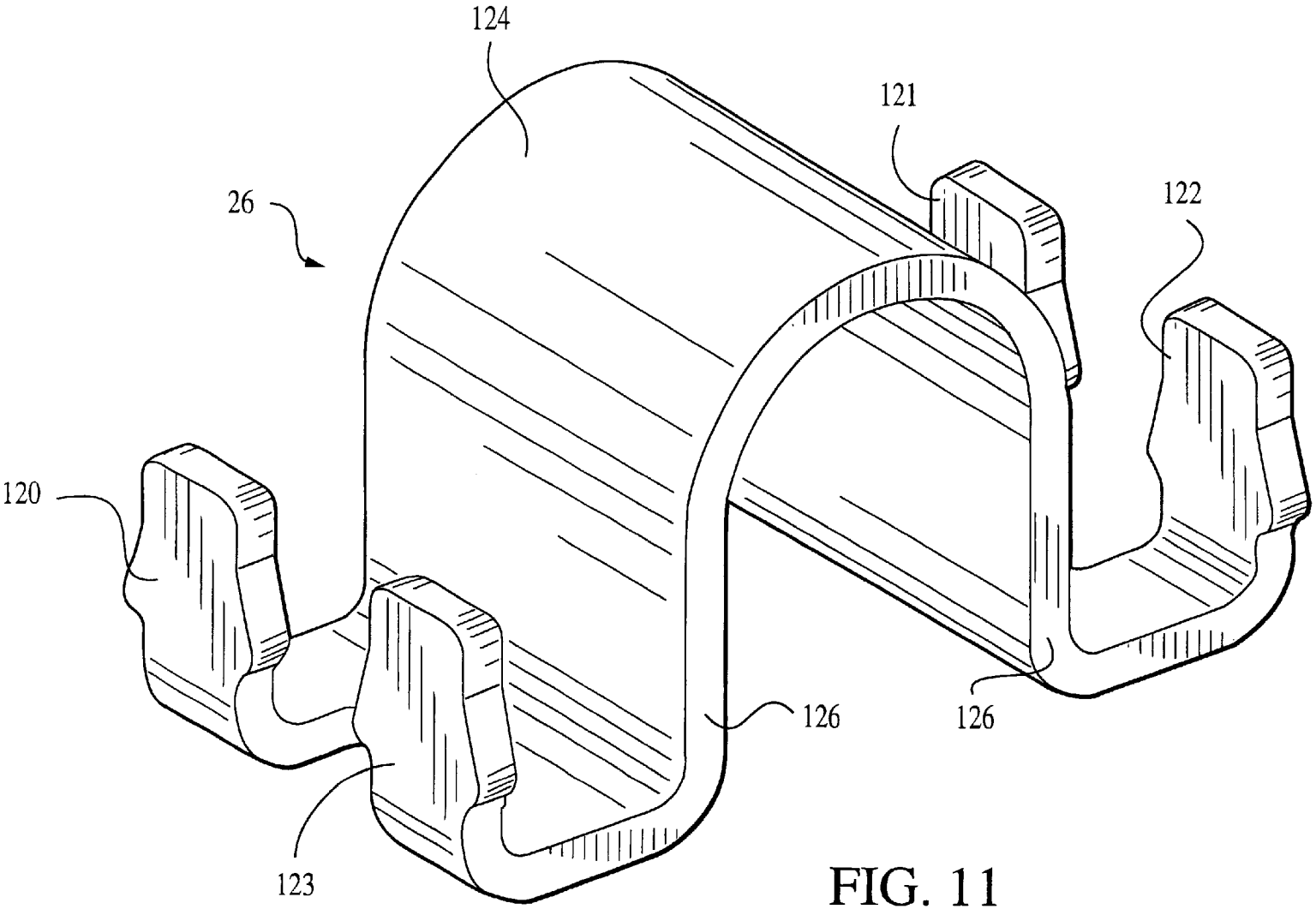
FIG. 11 illustrates a wear plate to be securely mounted to a cam assembly in accordance with a preferred embodiment of the present invention.

FIG. 10 illustrates the bottom side of the cam assembly 24. The cam assembly 24 may include a plurality of core voids 102 to prevent sink marks or excess shrinkage during manufacturing. Optionally, the cam assembly 24 may include beveled edges 104 to ensure adequate clearance during operation within the journaled portion 22. Multiple pockets 106–108 are provided to securely engage retention barbs 120–123 on the wear plate 26 (FIG. 11). The block section 48 includes closed ends 110 and 112 and the dome shaped top 49 to define a pocket 114 that securely receives the wear plate 26. The pocket 114 includes a recessed portion 116, vertical walls 118 and beveled edges 119 aligned to substantially conform to the shape of the wear plate 26. The recess 114 prevents lateral movement in the direction of arrow D by the wear plate 26 while the cam assembly 24 is moved in the direction of arrow A.

FIG. 11 illustrates the wear plate 26 which includes multiple retention barbs 120–123 integrally formed with top and side sections 124 and 126. The top and side sections 124 and 126 rotatably receive the cam journal 38 and permit pivotal and arcuate motion of the cam journal 38 while moving the socket 10 between the open and closed positions. Optionally, the wear plate 26 may be press fit into the pocket 114. The retention barbs 120–123 are provided with a width sufficient to form an interference fit securely within the pockets 106–108.

Figure 12:
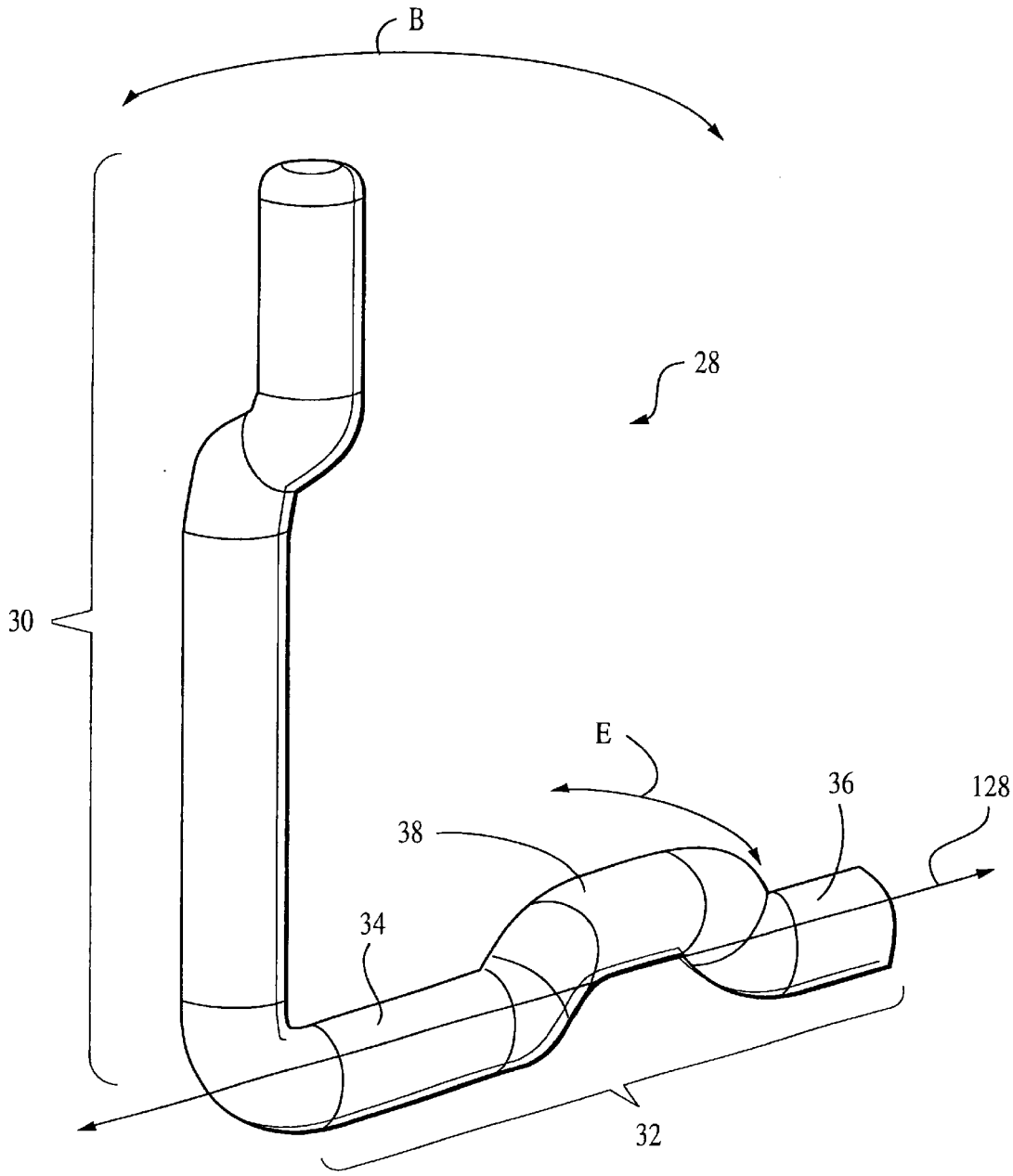
FIG. 12 illustrates an actuation lever rotatably housed between the cover and the base housing of a socket in accordance with a preferred embodiment of the present invention.

FIG. 12 illustrates the arcuate and pivotal motions carried out by the actuation lever 28 during operation. As the actuation lever 28 is moved along the direction designated by arrow B, the leg 32 pivots about the longitudinal axis 128, thereby causing the cam journal 38 to move about an arcuate path designated by arrow E within a vertical plane aligned perpendicular to the longitudinal axis 128. The cam journal 38 is offset from the longitudinal axis 128 by a distance necessary to actuate the cam assembly 24.

During operation, the actuation lever 28 is rotated along an arcuate path (see arrow B in FIG. 2) to cause a sliding lateral motion of the cam assembly 24 (see arrow A in FIG. 5), thereby causing the pusher bars 44 and slots 46 to cooperate to force the base housing 12 and cover 14 between open and closed positions.

Optionally, the actuation member 28 may be modified to include two or more legs 32 evenly distributed across the width of the base housing 12. Each leg 32 would be received in corresponding cutouts, such as cutouts 40 and 42, similarly distributed across the width of the socket. The cam assembly would include pockets, such as pocket 114, distributed along the length of the cam assembly and configured to rotatably receive cam journals on each leg. A linkage would be provided to connect each leg to one or more handles, such as handle 30, in order to simultaneously and synchronously rotate the legs.

Figure 14:
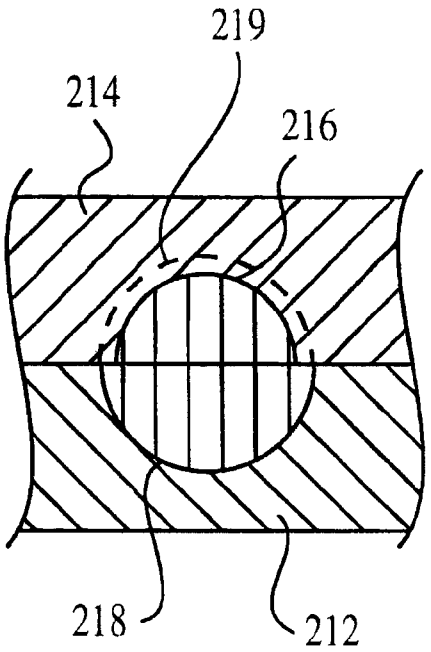
FIG. 14 illustrates a cross-sectional view taken along line 14—14 in FIG. 13 of a socket in accordance with an alternative embodiment of the present invention.
Figure 13:
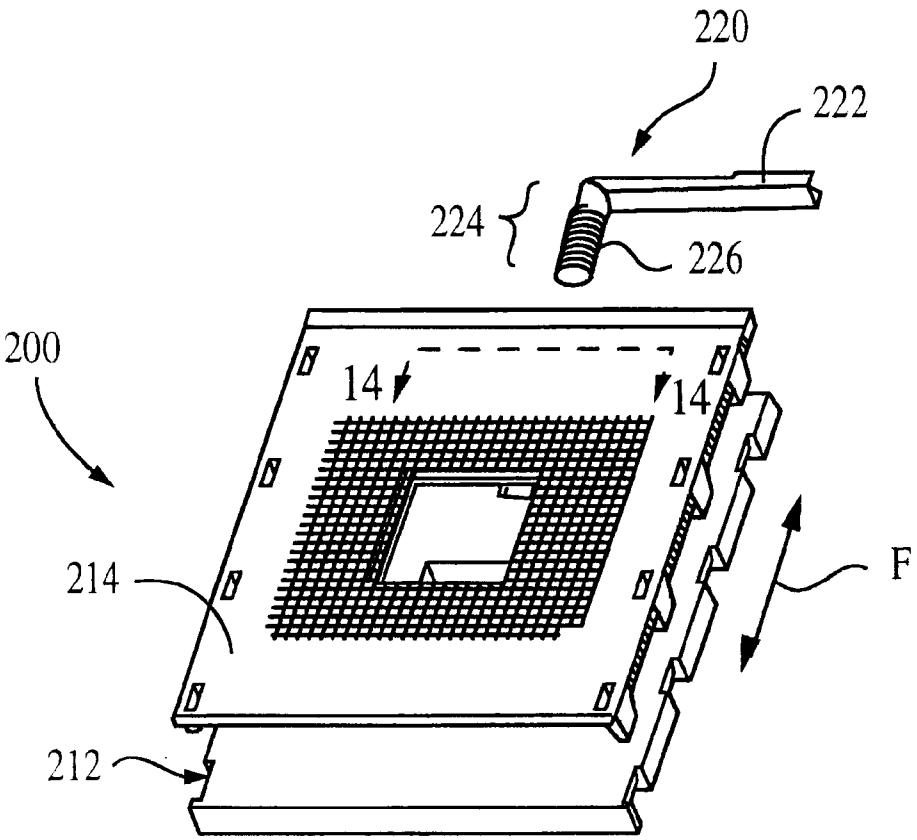
FIG. 13 illustrates a perspective view of a socket in accordance with an alternative embodiment of the present invention.

FIG. 13 illustrates an alternative embodiment for a socket 200 having a base 212 and cover 214. An actuation member 220 includes a handle 222 and a leg 224. The leg 224 includes a plurality of threads 226. FIG. 14 illustrates a cross-sectional view taken along line 14—14 in FIG. 13 of a portion of the socket 200. In FIG. 14, the cover 214 and base 212 slidably engage one another, whereby the direction of motion therebetween is indicated by arrow F in FIG. 13. The cover 214 and base 212 each include half moon shaped trough sections 216 and 218 that cooperate to define a chamber to receive the leg 224 of the actuation lever 220.

The cover 214 includes threaded recesses 219 engaging the threads 226 of the actuation member 220. As the handle 222 of the actuation member 220 is rotated about its rotational axis, the threads 226 and 219 cooperate to move the cover 214 in the direction of arrow F. Optionally, the base 212 may include threads within trough 218, while the threads 219 are removed from trough 216. The actuation lever 220 achieves forward and reverse sliding movement of the cover 214 relative to the base 212 by applying a screw type force between threads 226 and 219.

Alternatively, the embodiment of FIGS. 13 and 14 may be modified to include multiple threaded legs similar to leg 224. For instance, two or three threaded legs may be evenly spaced along the width of the socket 200, with a corresponding number of trough sections 216 and 218 similarly spaced along the width of the socket 200. In this alternative embodiment, the handle 222 may be modified to include a linkage interconnecting all of the threaded legs. The linkage would rotate the threaded sections simultaneously and synchronously in either direction. By using multiple threaded legs, the driving forces would be more evenly distributed across the width of the socket 200.

Alternatively, the embodiment of FIGS. 13 and 14 may be combined with the embodiments of FIGS. 1–12. For example, the cam assembly may be driven by a screw-type member such as the actuation member 220. The cam assembly may be moved in a direction parallel or perpendicular to the socket longitudinal axis, or at an acute angle thereto.

Figure 15:
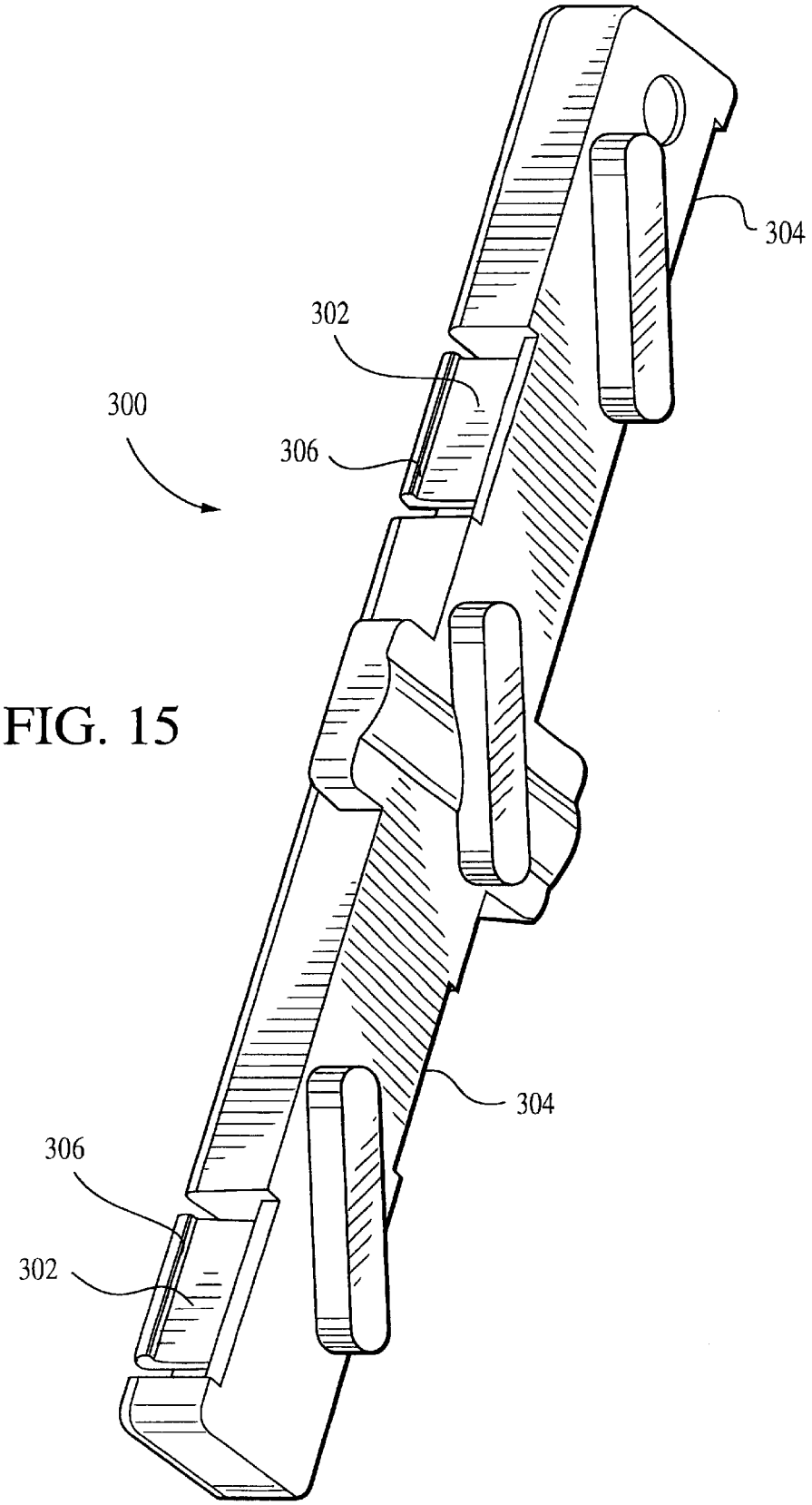
FIG. 15 illustrates a perspective view of a cam assembly constructed in accordance with an alternative embodiment of the present invention.

FIG. 15 illustrates an alternative embodiment for a cam assembly 300. The cam assembly 300 includes latch members 302 and 304 provided on either side thereof. The latches 302 and 304 are provided to retain the cam assembly 300 within the base housing. The latches 302 and 304 include shelves 306 that slidably engage corresponding structures within the base housing 14 to permit lateral side-to-side movement of the cam assembly 300, while retaining the cam assembly 300 within the base housing 14.

Figure 16:
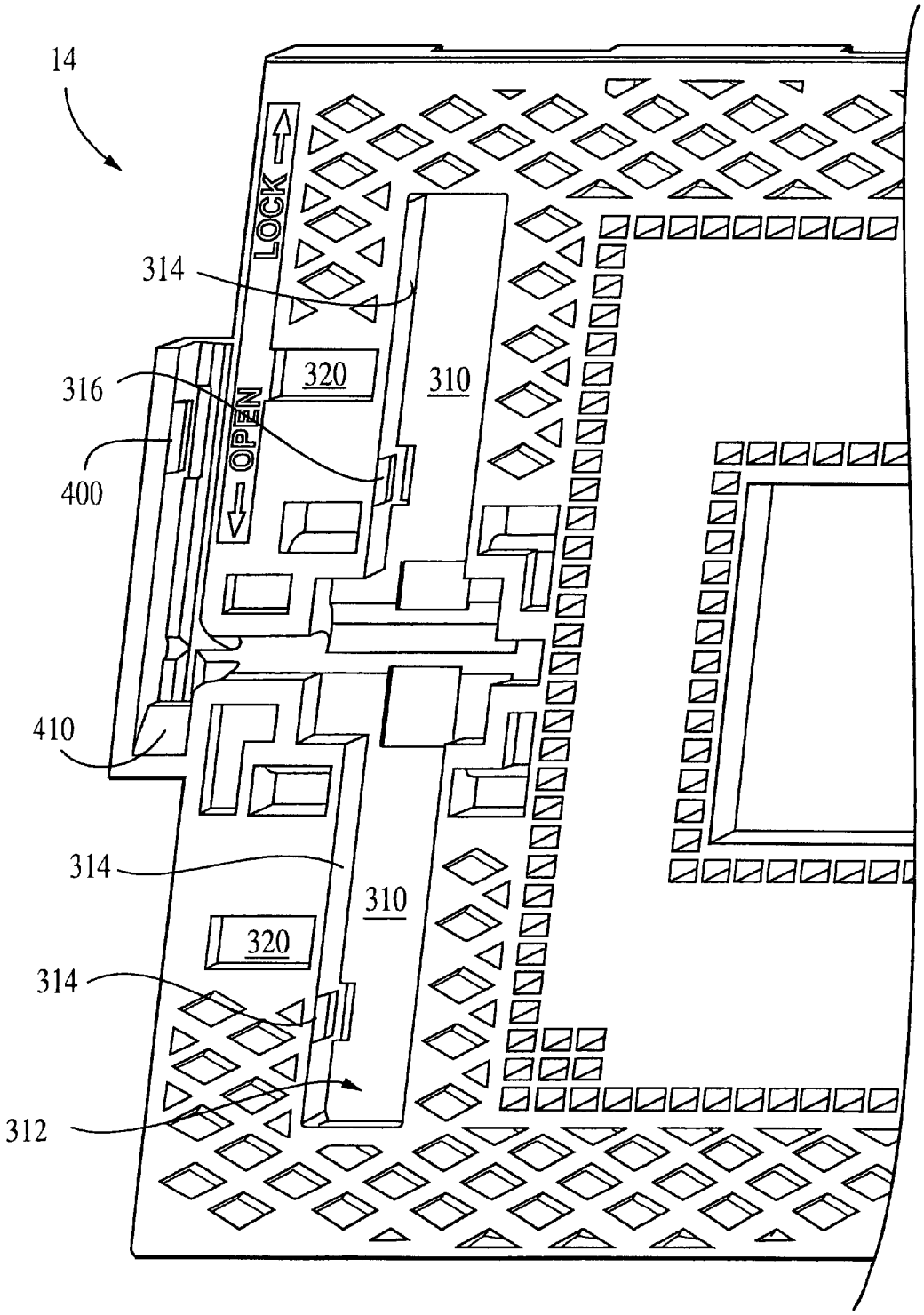
FIG. 16 illustrates a top view of a portion of the base housing as constructed in accordance with an alternative embodiment of the present invention.
Figure 17:
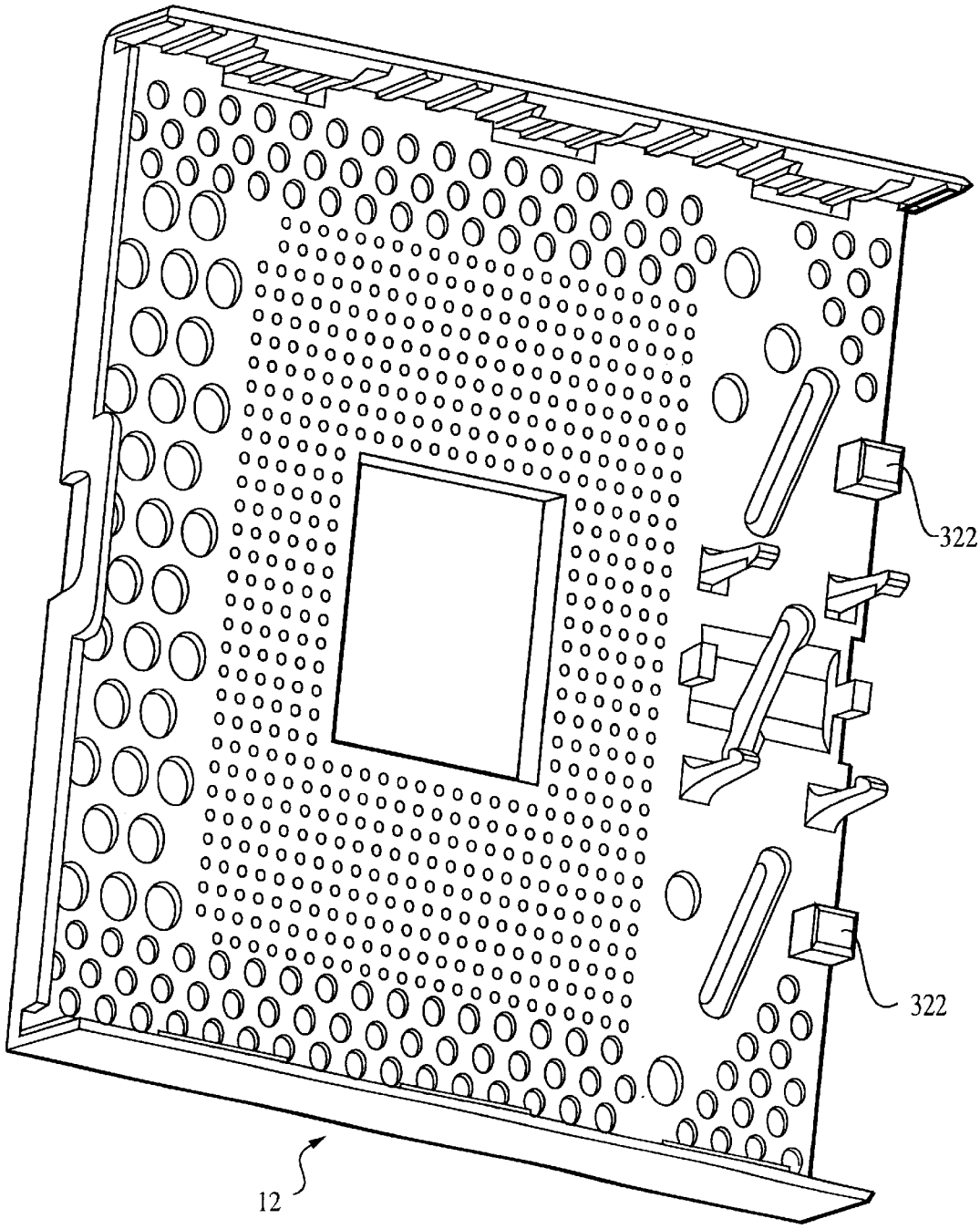
FIG. 17 illustrates a top perspective view of a portion of the inside of the cover as constructed in accordance with an alternative embodiment of the present invention.

FIG. 16 illustrates a portion of the base housing 14 including tracks 310 within the journaled portion 312. The tracks 310 include sidewalls 314 having latches 316 provided therein to slidably engage the latches 302 and 304 on the cam assembly 300. While not illustrated, latches resembling latches 316 are provided in the opposite side of tracks 310. The base housing 14 illustrated in FIG. 16 further includes pockets 320 that cooperate with posts 322 mounted on the interior of the cover 12. FIG. 17 illustrates an interior of a cover 12 including posts 322 that are received within pockets 320. Pockets 320 and posts 322 cooperate to prevent rotation of the cover 12 while the lever 16 is rotated and the cam assembly 24 is slid from side-to-side.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A socket for an electronic package, comprising:

a base housing;

a cover which is movable along a longitudinal axis relative to the base housing; and an actuation member mounted for rotation about a rotation axis that is parallel to the longitudinal axis, the actuation member being operably connected for moving the cover along the longitudinal axis when the actuation member is rotated about the rotation axis.

2. The socket of claim 1, wherein the actuation member includes a leg that extends along the rotation axis, and a handle that extends perpendicular to the leg.

3. The socket of claim 2, wherein the leg includes at least one thread that is received in a recess in the cover.

4. The socket of claim 2, wherein the leg includes multiple threads that engage corresponding threads in the cover.

5. A socket for an electronic package, comprising:

a base housing;

a cover which is movable along a longitudinal axis relative to the base housing; and an actuation member mounted for rotation about a rotation axis that is parallel to the longitudinal axis, the actuation member including a leg that extends along the rotation axis, the leg including threads engaging corresponding threads in the cover, the leg driving the cover along the longitudinal axis as the actuation member is rotated.

6. A socket for an electronic package, comprising:

a base housing;

a cover which is movable along a longitudinal axis relative to the base housing; and an actuation member mounted for rotation about a rotation axis that is parallel to the longitudinal axis, the actuation member including a threaded shaft centrally disposed between sides of the base housing, the threaded shaft causing the cover to move when the actuation member is rotated.

* * * * *